US012703471B2

(12) United States Patent
Saruwatari et al.

(10) Patent No.: US 12,703,471 B2
(45) Date of Patent: Aug. 11, 2026

(54) OUTBOARD MOTOR AND BOAT

(71) Applicant: YAMAHA HATSUDOKI KABUSHIKI KAISHA, Iwata (JP)

(72) Inventors: Kimitaka Saruwatari, Shizuoka (JP); Yu Wakamizu, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 698 days.

(21) Appl. No.: 18/079,926

(22) Filed: Dec. 13, 2022

(65) Prior Publication Data

US 2023/0415874 A1 Dec. 28, 2023

(30) Foreign Application Priority Data

Jun. 24, 2022 (JP) ..... 2022-101797

(51) Int. Cl.

| | |
|---|---|
| ***B63H 20/28*** | (2006.01) |
| ***B63H 20/02*** | (2006.01) |
| ***B63H 20/12*** | (2006.01) |
| ***B63H 20/14*** | (2006.01) |

(52) U.S. Cl.

CPC ..... *B63H 20/12* (2013.01); *B63H 20/02* (2013.01); *B63H 20/14* (2013.01); *B63H 20/285* (2013.01)

(58) Field of Classification Search

None

See application file for complete search history.

(56) References Cited

U.S. PATENT DOCUMENTS

| | | | | |
|---|---|---|---|---|
| 3,164,121 | A * | 1/1965 | Alexander, Jr. ..... | F01P 3/202 440/88 P |
| 3,310,021 | A * | 3/1967 | Shimanckas ..... | B63H 23/30 440/61 G |
| 5,487,687 | A * | 1/1996 | Idzikowski ..... | F02B 61/045 440/88 L |
| 9,475,560 | B1 * | 10/2016 | Jaszewski ..... | B63H 20/32 |
| 10,800,502 | B1 | 10/2020 | Alby et al. | |
| 2010/0173543 | A1 | 7/2010 | Inaba | |

FOREIGN PATENT DOCUMENTS

JP 2010-158926 A 7/2010

* cited by examiner

*Primary Examiner* — Kayla Mccaffrey

(74) *Attorney, Agent, or Firm* — Keating & Bennett, LLP

(57) ABSTRACT

An outboard motor includes an engine, a propeller shaft, a propeller attached to the propeller shaft, a transmission to transmit rotation of the engine to the propeller shaft, an upper accommodation body accommodating at least a portion of the engine, a lower accommodation body accommodating at least a portion of the propeller shaft, and a steering to cause the lower accommodation body to rotate about a steering axis with respect to the upper accommodation body. The upper accommodation body includes an upper coolant channel. The lower accommodation body includes a lower coolant channel including a coolant intake port. A communication area between the upper and lower coolant channels is changeable according to a rudder angle of the steering.

14 Claims, 14 Drawing Sheets

OUTBOARD MOTOR AND BOAT

CROSS-REFERENCE TO RELATED APPLICATIONS

The present application claims priority to Japanese Patent Application No. 2022-101797, filed on Jun. 24, 2022. The contents of this application are hereby incorporated herein by reference in their entirety.

BACKGROUND OF THE INVENTION

1. Field of the Invention

The present disclosure relates to an outboard motor and a boat.

2. Description of the Related Art

A boat includes a hull and an outboard motor attached to a rear portion of the hull. The outboard motor generates a propulsion force to propel the boat. The outboard motor has an engine, a propeller shaft, a propeller attached to the propeller shaft, a transmission mechanism that transmits rotation of the engine to the propeller shaft, an upper accommodation body that accommodates at least a portion of the engine, and a lower accommodation body that accommodates at least a portion of the propeller shaft.

The outboard motor also has a steering mechanism that causes the outboard motor to rotate about a steering axis. When a direction of the propeller is changed by the steering mechanism, a direction of the propulsion force, which is generated by the propeller, with respect to a direction of the hull is changed, and an advancing direction of the boat is thus changed. In general, the steering mechanism of the outboard motor is configured to cause a unit including the upper accommodation body and the lower accommodation body to rotate about the steering axis.

Conventionally, the following configuration (hereinafter referred to as a "lower-only steering configuration") of the outboard motor has been proposed (for example, see U.S. Pat. No. 10,800,502). The outboard motor includes the steering mechanism that causes the lower accommodation body to rotate about the steering axis with respect to the upper accommodation body. In the lower-only steering configuration, only the lower accommodation body rotates while the upper accommodation body does not rotate during steering. For such a reason, the upper accommodation body does not interfere with other parts of the boat in association with steering, and thus a maximum rudder angle can be increased.

The outboard motor includes a coolant channel through which a coolant for cooling the engine flows. More specifically, the upper accommodation body includes an upper coolant channel, and the lower accommodation body includes a lower coolant channel that has a coolant intake port. The coolant that is pumped from the coolant intake port flows through the lower coolant channel and the upper coolant channel and is then supplied to the engine.

In the above-described conventional lower-only steering configuration, in order to keep a constant communication area between the upper coolant channel and the lower coolant channel regardless of the rudder angle, an annular communication channel is provided to communicate the upper coolant channel and the lower coolant channel for an entire circumference around the steering axis. For this reason, such a problem occurs that a space for forming the coolant channel in the outboard motor is increased, which reduces a degree of freedom in layout of the outboard motor, and increases a size and weight of the outboard motor.

SUMMARY OF THE INVENTION

Preferred embodiments of the present invention disclose techniques able to solve the above-described problem.

Preferred embodiments of the present invention may be implemented in the following aspects, for example.

According to a preferred embodiment of the present invention, an outboard motor includes an engine, a propeller shaft, a propeller attached to the propeller shaft, a transmission to transmit rotation of the engine to the propeller shaft, an upper accommodation body that accommodates at least a portion of the engine, a lower accommodation body that accommodates at least a portion of the propeller shaft, and a steering to cause the lower accommodation body to rotate about a steering axis with respect to the upper accommodation body. The upper accommodation body includes an upper coolant channel. The lower accommodation body includes a lower coolant channel including a coolant intake port. A communication area between the upper coolant channel and the lower coolant channel is changeable according to a rudder angle of the steering.

The lower accommodation body, which accommodates the propeller shaft, is rotatable (steerable) with respect to the upper accommodation body, which accommodates the engine. Thus, compared to a configuration that the upper accommodation body and the lower accommodation body are integrated and rotate with respect to a hull, a maximum rudder angle is increased. In addition, the communication area between the upper coolant channel and the lower coolant channel is changeable according to the rudder angle. Therefore, compared to a configuration that an annular communication channel is provided to one of the upper coolant channel and the lower coolant channel and thus the communication area therebetween is constant regardless of the rudder angle, it is possible to reduce a space to provide the coolant channel and thus improve a degree of freedom in layout of the outboard motor, and to reduce a size and weight of the outboard motor.

According to another preferred embodiment of the present invention, an outboard motor includes an engine, a propeller shaft, a propeller attached to the propeller shaft, a transmission to transmit rotation of the engine to the propeller shaft, an upper accommodation body that accommodates at least a portion of the engine, a lower accommodation body that accommodates at least a portion of the propeller shaft, and a steering to cause the lower accommodation body to rotate about a steering axis with respect to the upper accommodation body. The upper accommodation body includes an upper coolant channel. The lower accommodation body includes a lower coolant channel including a coolant intake port. A communication area between the upper coolant channel and the lower coolant channel is changeable according to at least one of a rudder angle of the steering and a speed of the engine.

The lower accommodation body, which accommodates the propeller shaft, rotates (steers) with respect to the upper accommodation body, which accommodates the engine. Thus, compared to a configuration that the upper accommodation body and the lower accommodation body are integrated and rotate with respect to a hull, a maximum rudder angle is increased. In addition, the communication area between the upper coolant channel and the lower coolant channel is changeable according to at least one of the rudder angle and the speed of the engine. Therefore, compared to a configuration that an annular communication channel is provided to one of the upper coolant channel and the lower coolant channel and thus the communication area therebetween is constant regardless of the rudder angle or the speed of the engine, it is possible to reduce the space to provide the coolant channel and thus improve the degree of freedom in layout of the outboard motor, and to reduce the size and the weight of the outboard motor.

Preferred embodiments of the present invention may be implemented in various aspects, and, for example, may be implemented in the aspects of outboard motors, boats including outboard motor and hulls, and the like.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
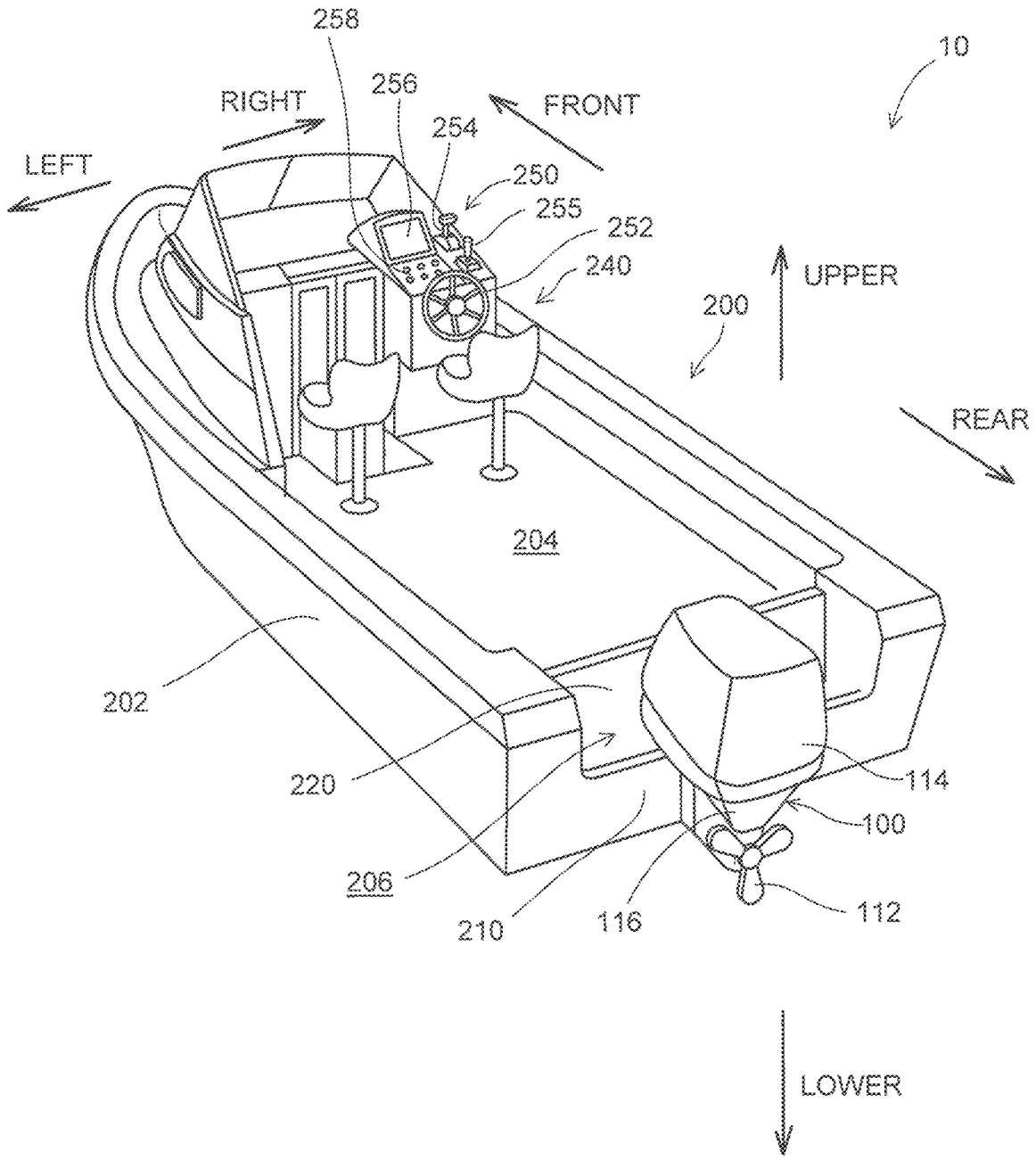
FIG. 1 is a perspective view schematically illustrating a configuration of a boat according to a preferred embodiment of the present invention.

FIG. 1 is a perspective view schematically illustrating a configuration of a boat 10 according to a preferred embodiment of the present invention. In FIG. 1 and the other figures, which will be described below, arrows indicate directions that are defined based on a position of the boat 10. More specifically, in each of the drawings, the arrows indicate forward (FRONT), rearward (REAR), leftward (LEFT), rightward (RIGHT), upward (UPPER), and downward (LOWER). A front-rear direction, a right-left direction, and an up-down direction (vertical direction) are orthogonal to each other.

The boat 10 includes a hull 200 and an outboard motor 100.

The hull 200 is a portion of the boat 10 where a crew is on board. The hull 200 includes a hull body 202 including a living space 204, a helm seat 240 in the living space 204, and a helm system 250 near the helm seat 240. The helm system 250 operates the boat and, for example, includes a steering wheel 252, a shift throttle lever 254, a joystick 255, a monitor 256, and an input device 258. The hull 200 also includes a partition wall 220 that defines a rear end of the living space 204, and a transom 210 located at a rear end of the hull 200. In the front-rear direction, a space 206 exists between the transom 210 and the partition wall 220.

Figure 2:
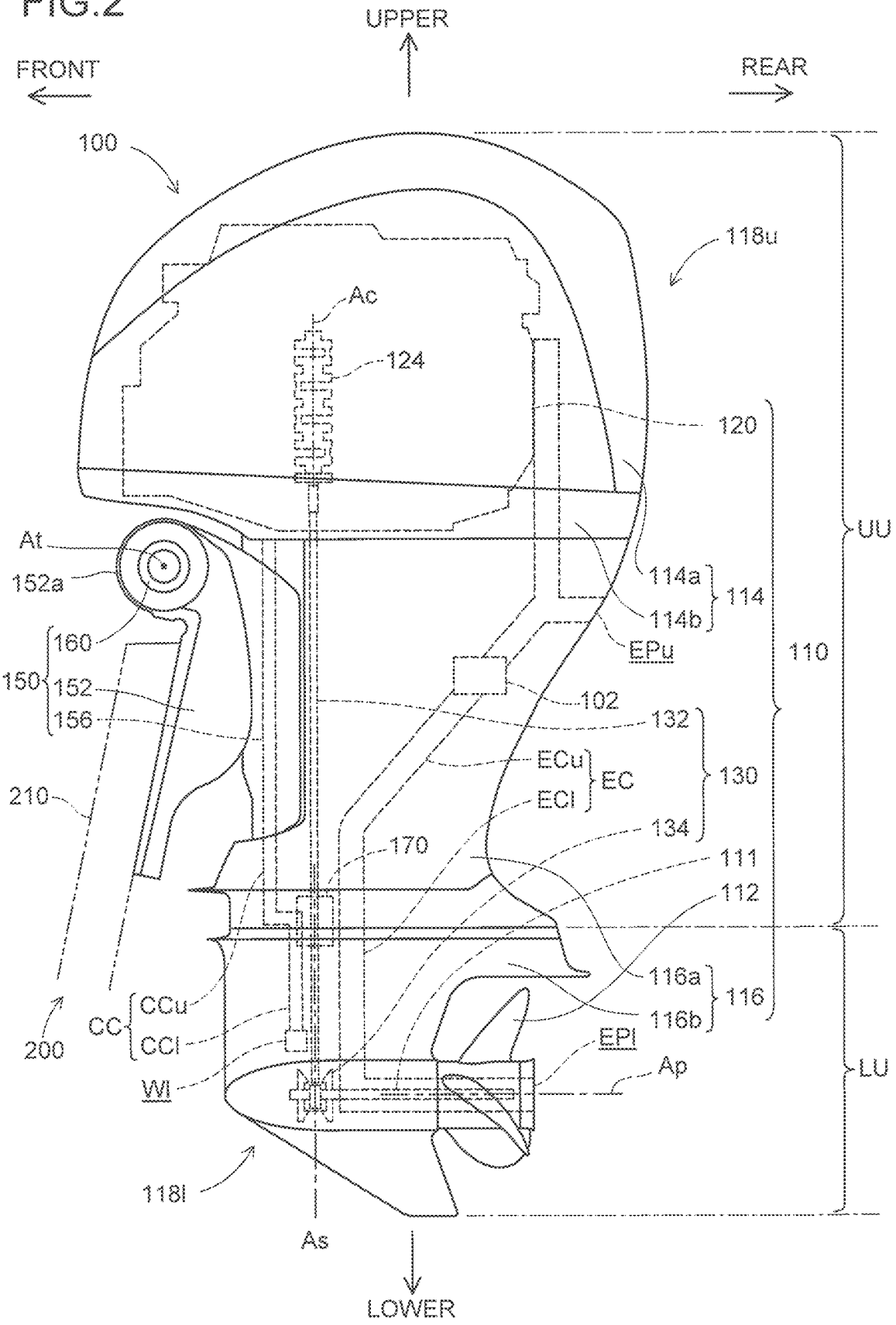
FIG. 2 is a side view schematically illustrating a configuration of an outboard motor.

FIG. 2 is a side view schematically illustrating a configuration of the outboard motor 100. A description will hereinafter be made of the outboard motor 100 in a reference posture unless otherwise noted. The reference posture is a posture in which a rotation axis Ac of a crankshaft 124, which will be described below, extends in the up-down direction and a rotation axis Ap of a propeller shaft 111 extends in the front-rear direction. Each of the front-rear direction, the right-left direction, and the up-down direction is defined based on the outboard motor 100 in the reference posture.

The outboard motor 100 generates a propulsion force to propel the boat 10. The outboard motor 100 is attached to the transom 210 at a rear portion of the hull 200. The outboard motor 100 includes an outboard motor body 110, a suspension device 150, and a steering mechanism 170.

The outboard motor body 110 includes an engine 120, the propeller shaft 111, a propeller 112, a transmission mechanism 130, a cowl 114, and a casing 116.

The cowl 114 is an accommodation body that is arranged in an upper portion of the outboard motor body 110. The cowl 114 includes a lower cowl **114*b* that defines a lower portion of the cowl 114, and an upper cowl 114*a* that defines an upper portion of the cowl 114. The upper cowl 114*a* is detachably attached to the lower cowl 114*b***.

The casing 116 is an accommodation body that is located under the cowl 114 and is arranged in a lower portion of the outboard motor body 110. The casing 116 includes a lower casing **116*b* that defines a lower portion of the casing 116, and an upper casing 116*a* that defines an upper portion of the casing 116**.

In the following description, the cowl 114 and the upper casing **116*a* will also collectively be referred to as an "upper accommodation body 118*u*", and the lower casing 116*b* will also be referred to as a "lower accommodation body 1181". In addition, the upper accommodation body 118*u* and components of the outboard motor body 110 that are accommodated in or integrated with the upper accommodation body 118***u* will also collectively be referred to as an "outboard motor upper unit UU", and the lower accommodation body 1181 and components of the outboard motor body 110 that are accommodated in or integrated with the lower accommodation body 1181 will also collectively be referred to as an "outboard motor lower unit LU".

The engine 120 is a prime mover that generates power. For example, the engine 120 includes an internal combustion engine. The engine 120 is arranged at a relatively upper position in the outboard motor body 110, and at least a portion of the engine 120 is accommodated in the cowl 114. The engine 120 includes the crankshaft 124 that converts reciprocating motion of an unillustrated piston into rotational motion. The crankshaft 124 is arranged in such a posture that the rotation axis Ac thereof extends in the up-down direction.

The propeller shaft 111 is a rod-shaped member. In a posture of extending in the front-rear direction, the propeller shaft 111 is arranged at a relatively lower position in the outboard motor body 110. At least a portion of the propeller shaft 111 is accommodated in the lower casing 116*b*. More specifically, a front end portion of the propeller shaft 111 is accommodated in the lower casing 116*b*, and a rear end portion of the propeller shaft 111 projects rearward from the lower casing 116*b*.

The propeller 112 is a rotating body that includes a plurality of blades. The propeller 112 is attached to the rear end portion of the propeller shaft 111. The propeller 112 rotates in conjunction with rotation of the propeller shaft 111 about the rotation axis Ap. The propeller 112 generates the propulsion force when rotating.

The transmission mechanism 130 transmits rotation of the engine 120 to the propeller shaft 111. At least a portion of the transmission mechanism 130 is accommodated in the casing 116. The transmission mechanism 130 includes a driveshaft 132 and a shift mechanism 134.

The driveshaft 132 is a rod-shaped member. At a position under the crankshaft 124 of the engine 120, the driveshaft 132 is arranged in a posture of extending in the up-down direction. An upper end portion of the driveshaft 132 is coupled to the crankshaft 124. The driveshaft 132 rotates in conjunction with the rotation of the engine 120 (rotation of the crankshaft 124).

The shift mechanism 134 is coupled to a lower portion of the driveshaft 132, and is also coupled to the front end portion of the propeller shaft 111. For example, the shift mechanism 134 includes a plurality of gears and a clutch that switches meshing of the gears, and transmits rotation of the driveshaft 132, which is associated with the rotation of the engine 120, to the propeller shaft 111 so as to switch a rotational direction thereof. In the case where the shift mechanism 134 transmits the rotation of the driveshaft 132 as rotation in a normal rotational direction to the propeller shaft 111, the propeller 112 that rotates with the propeller shaft 111 in the normal rotational direction generates the propulsion force in a forward advancing direction. On the contrary, in the case where the shift mechanism 134 transmits the rotation of the driveshaft 132 as rotation in a reverse direction to the propeller shaft 111, the propeller 112 that rotates with the propeller shaft 111 in the reverse direction generates the propulsion force in a rearward advancing direction.

The suspension device 150 suspends or supports the outboard motor body 110 from the hull 200. The suspension device 150 includes a right and left pair of clamp brackets 152, a tilt shaft 160, and a connection bracket 156.

The right and left pair of clamp brackets 152 are arranged behind the hull 200 in a mutually separated state in the right-left direction, and are fixed to the transom 210 of the hull 200 by bolts, for example. Each of the clamp brackets 152 includes a cylindrical support section 152*a* that includes a through hole extending in the right-left direction.

The tilt shaft 160 is a rod-shaped member. The tilt shaft 160 is rotatably supported in the through hole of the support section 152*a* of the clamp bracket 152. A tilt axis At as a centerline of the tilt shaft 160 defines an axis in a horizontal direction (the right-left direction) of tilt operation of the outboard motor 100.

The connection bracket 156 is held between the pair of the clamp brackets 152 and is supported by the support sections 152*a* of the clamp brackets 152 via the tilt shaft 160 so as to be rotatable about the tilt axis At. The connection bracket 156 is fixed to the outboard motor body 110. The connection bracket 156 is driven by a tilt device (not illustrated) that includes an actuator such as a hydraulic cylinder so as to rotate about the tilt axis At with respect to the clamp bracket 152.

When the connection bracket 156 rotates about the tilt axis At with respect to the clamp bracket 152, the outboard motor body 110 that is fixed to the connection bracket 156 also rotates about the tilt axis At. In this way, the tilt operation that causes the outboard motor body 110 to rotate in the up-down direction with respect to the hull 200 is performed. By the tilt operation of the outboard motor 100, an angle of the outboard motor body 110 around the tilt axis At is changed within a range from a tilt down state where the propeller 112 is located in the water (a state where the outboard motor 100 is in the reference posture) to a tilt up state where the propeller 112 is located above the water surface. Trim operation is also performed to adjust a posture of the boat 10 during traveling by adjusting the angle of the outboard motor body 110 around the tilt axis At.

Figure 3:
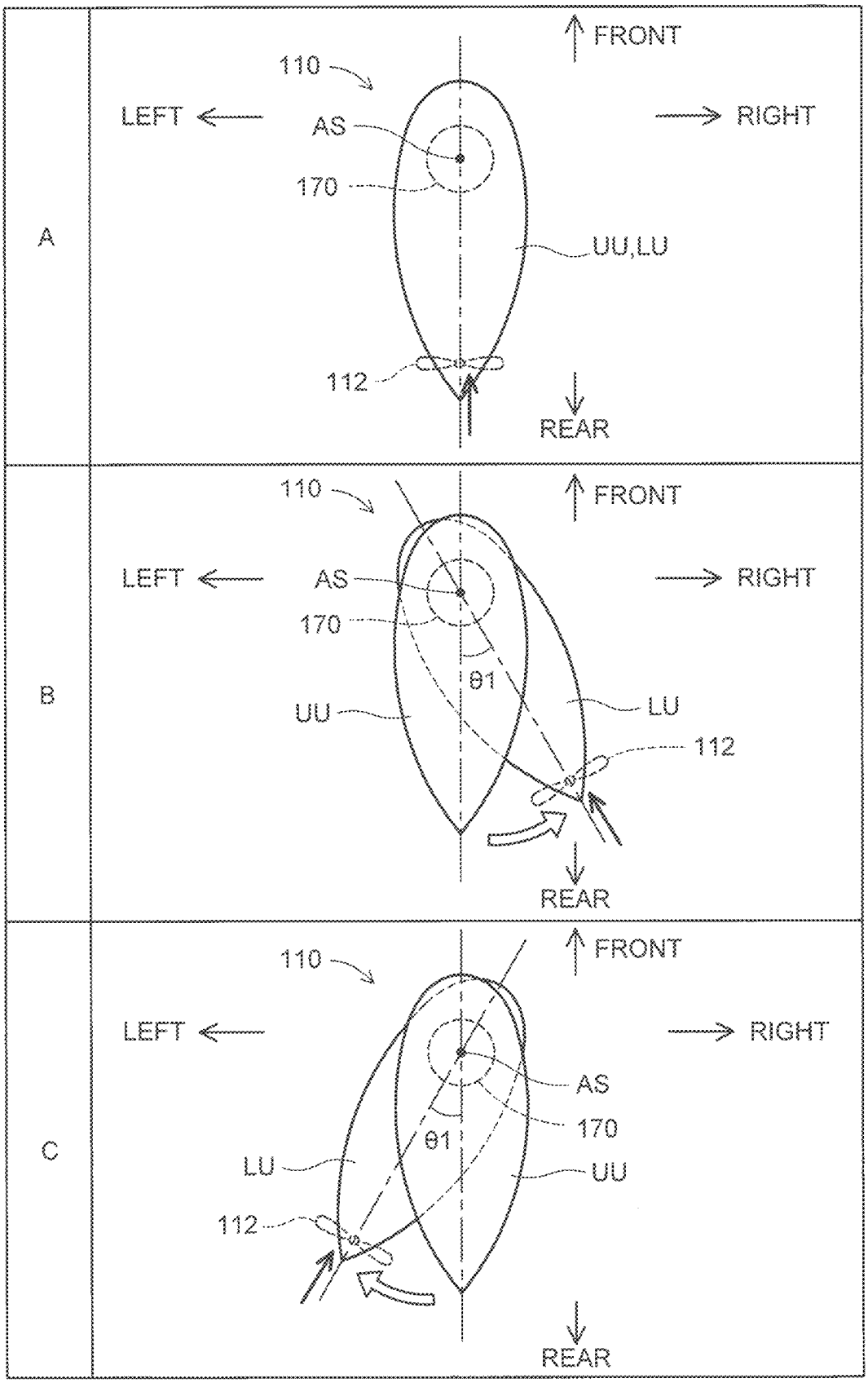
FIG. 3 includes explanatory views schematically illustrating steering states by a steering mechanism.

The steering mechanism 170 steers the outboard motor 100. FIG. 3 includes explanatory views schematically illustrating steering states of the steering mechanism 170. As illustrated in FIG. 3, the steering mechanism 170 is configured to steer by causing the outboard motor lower unit LU of the outboard motor body 110 to rotate about a steering axis As. In other words, the steering mechanism 170 causes the lower accommodation body 1181 (the lower casing 116*b*) to rotate about the steering axis As with respect to the upper accommodation body 118*u* (the cowl 114 and the upper casing 116*a*) illustrated in FIG. 2. In the present preferred embodiment, the steering axis As is a center axis of the driveshaft 132.

Row A of FIG. 3 illustrates a state where the outboard motor lower unit LU does not rotate about the steering axis As with respect to the outboard motor upper unit UU (that is, a rudder angle θ1 is 0°). In this state, the propulsion force that is generated by the propeller 112 provided in the outboard motor lower unit LU is directed forward, and thus a bow advances forward.

Row B in FIG. 3 illustrates a right steering state where the outboard motor lower unit LU rotates counterclockwise about the steering axis As at the rudder angle θ1 with respect to the outboard motor upper unit UU. In this state, the propulsion force that is generated by the propeller 112 is directed forward and obliquely leftward. Thus, a stern is pushed to the left, and the bow advances forward while turning to the right.

Row C in FIG. 3 illustrates a left steering state where the outboard motor lower unit LU rotates clockwise about the steering axis As at the rudder angle 01 with respect to the outboard motor upper unit UU. In this state, the propulsion force that is generated by the propeller 112 is directed forward and obliquely rightward. Thus, the stern is pushed to the right, and the bow advances forward while turning to the left.

As described above, the steering mechanism 170 causes the outboard motor lower unit LU to rotate about the steering axis As. In this way, the direction of the propulsion force, which is generated by the propeller 112 with a direction of the hull 200 being a reference, is changed, and the boat 10 is thus steered. In the present preferred embodiment, at the time of steering by the steering mechanism 170, only the outboard motor lower unit LU rotates about the steering axis As, and the outboard motor upper unit UU does not rotate. For such a reason, the outboard motor upper unit UU does not interfere with other portions of the boat 10 in association with steering, and thus a maximum rudder angle is increased.

Figure 4:
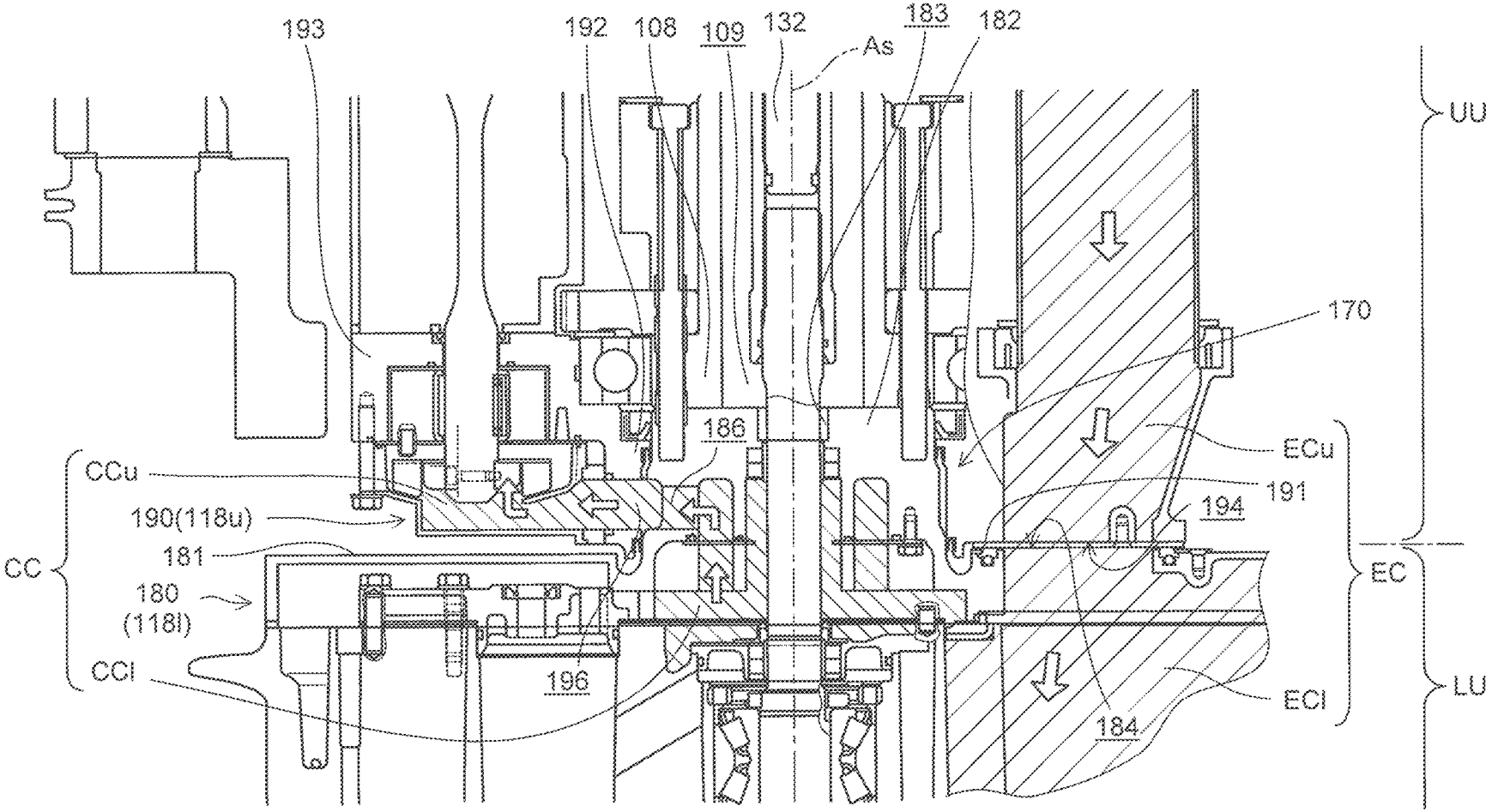
FIG. 4 is an explanatory view illustrating a configuration near a boundary between an outboard motor upper unit UU and an outboard motor lower unit LU.
Figure 5:
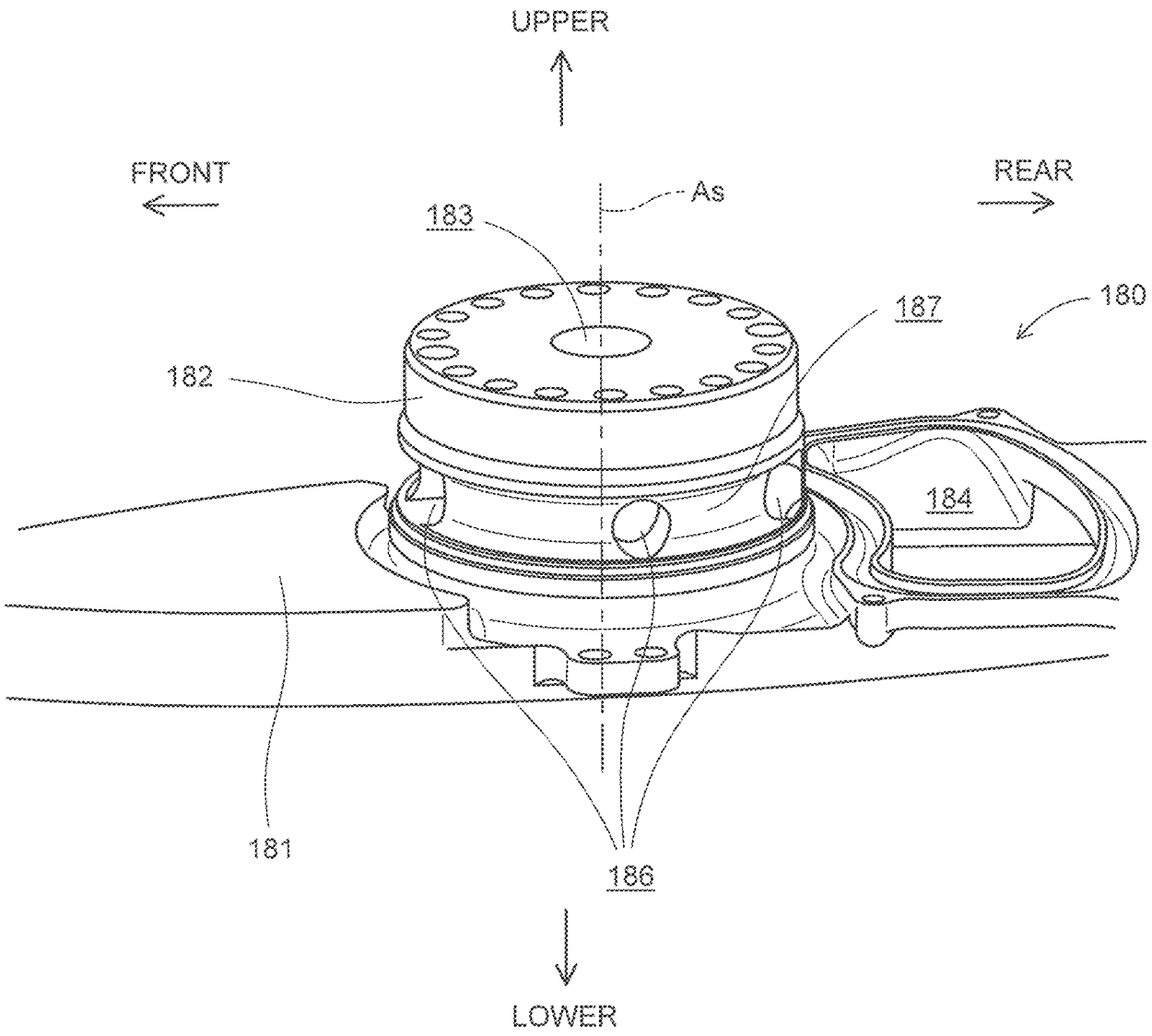
FIG. 5 is an explanatory view illustrating the configuration near the boundary between the outboard motor upper unit UU and the outboard motor lower unit LU.
Figure 6:
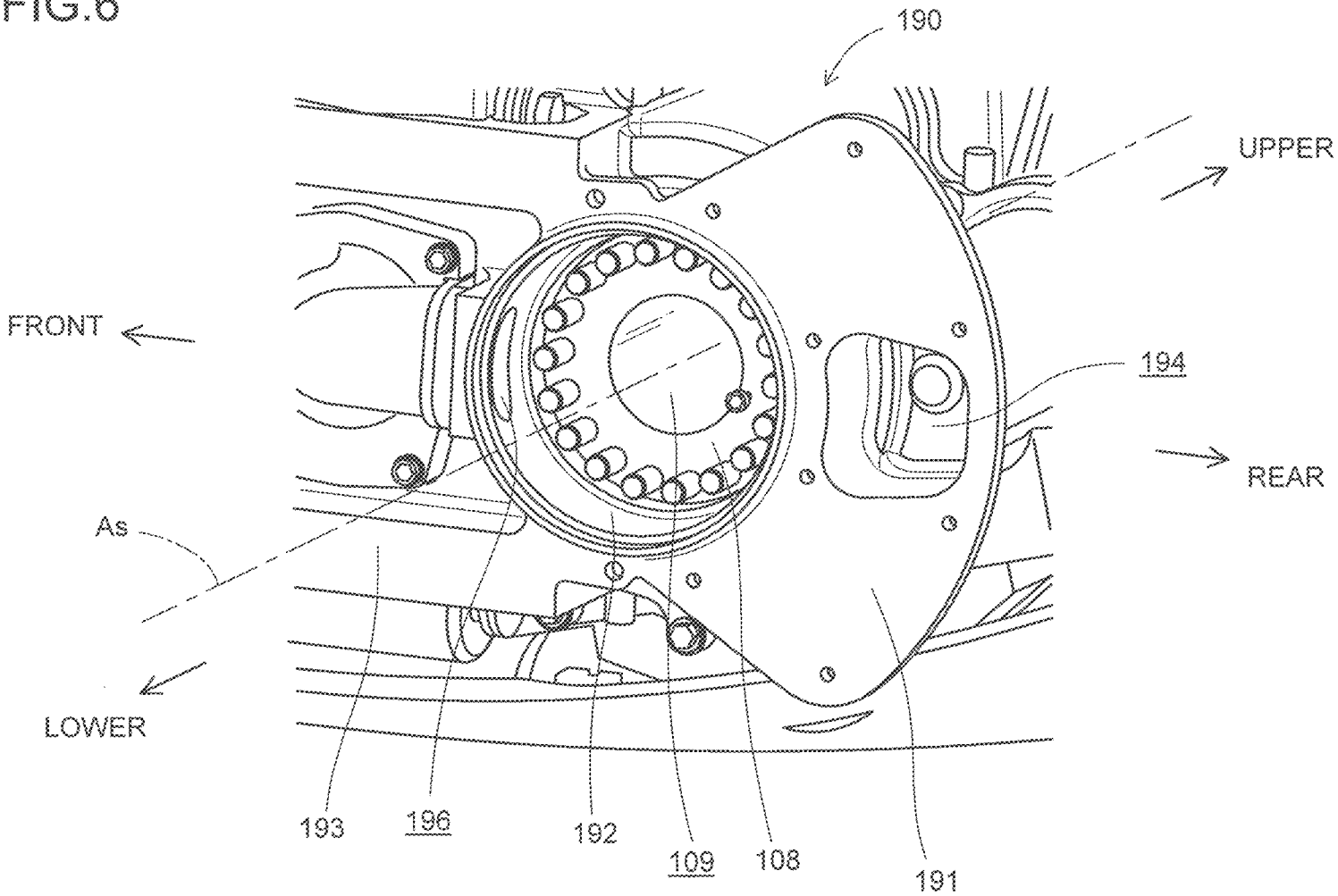
FIG. 6 is an explanatory view illustrating the configuration near the boundary between the outboard motor upper unit UU and the outboard motor lower unit LU.
Figure 7:
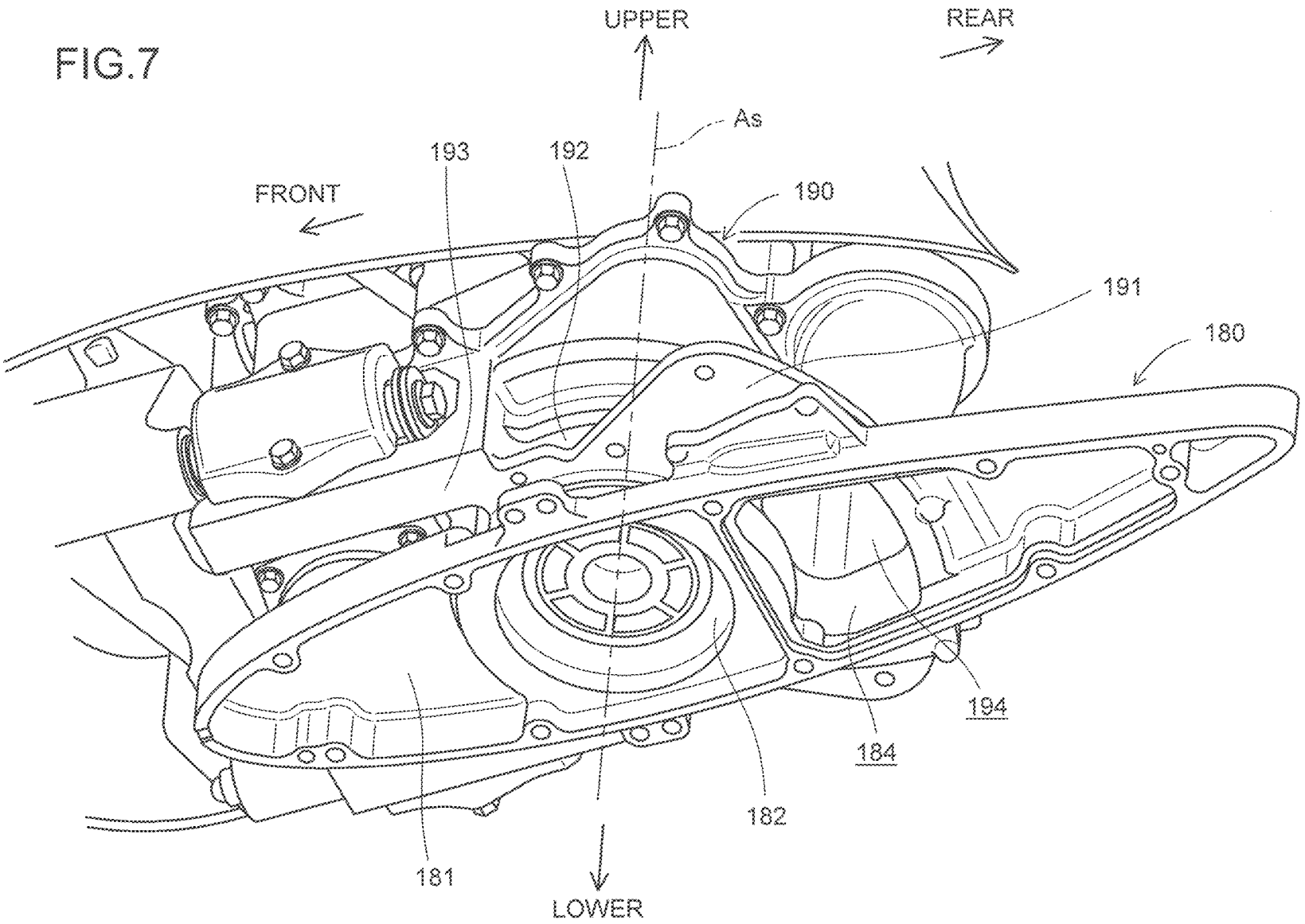
FIG. 7 is an explanatory view illustrating the configuration near the boundary between the outboard motor upper unit UU and the outboard motor lower unit LU.

FIG. 4 to FIG. 7 are each an explanatory view illustrating a configuration near a boundary between the outboard motor upper unit UU and the outboard motor lower unit LU. FIG. 4 illustrates a cross-sectional configuration near the boundary, FIG. 5 illustrates an exterior configuration of a lower component 180 as a portion of the lower accommodation body 1181, which defines the outboard motor lower unit LU, FIG. 6 illustrates an exterior configuration of an upper component 190 as a portion of the upper accommodation body 118*u*, which defines the outboard motor upper unit UU, and FIG. 7 illustrates a connection relationship between the lower component 180 and the upper component 190.

As illustrated in FIGS. 4, 5, and 7, the lower component 180 is a member that defines a topmost portion of the lower accommodation body 1181 in the outboard motor lower unit LU. The lower component 180 includes a flat plate section 181 and a tubular section 182 that projects upward from the flat plate section 181 and has a cylindrical or substantially cylindrical shape. An upper surface of the tubular section 182 is covered, and a through hole 183 is provided in the upper surface. The driveshaft 132 is inserted through the through hole 183. The lower component 180 is able to rotate about the steering axis As with respect to the driveshaft 132.

As illustrated in FIGS. 4, 6, and 7, the upper component 190 is a member that defines a lowermost portion of the upper accommodation body 118*u* in the outboard motor upper unit UU. The upper component 190 includes a flat plate section 191, a tubular section 192 that projects upward from the flat plate section 191 and has a cylindrical or substantially cylindrical shape, and a box-shaped section 193 that is located on an opposite side (a front side) of the tubular section 192 from the flat plate section 191.

A cylindrical or substantially cylindrical rotation member 108 includes a through hole 109 that extends in the up-down direction, and is accommodated in a hollow portion of the tubular section 192 of the upper component 190. The driveshaft 132 is inserted through the through hole 109 of the rotation member 108. The rotation member 108 is able to rotate about the steering axis As with respect to the upper component 190 and the driveshaft 132. A tip portion of the tubular section 182 of the lower component 180 is inserted in the hollow portion below the rotation member 108 in the tubular section 192, and the tubular section 182 is joined to the rotation member 108 by a plurality of bolts, for example. Accordingly, the lower component 180 is able to rotate about the steering axis As with respect to the upper component 190 and the driveshaft 132 in an integrated manner with the rotation member 108. The steering mechanism 170 includes an actuator such as a hydraulic cylinder, and rotationally drives the outboard motor lower unit LU including the lower component 180 with respect to the outboard motor upper unit UU including the upper component 190. With such a configuration, a function of the steering mechanism 170 to cause the outboard motor lower unit LU to rotate about the steering axis As is implemented.

As illustrated in FIG. 2 and FIG. 4, the outboard motor body 110 includes an exhaust channel EC to discharge exhaust gas from the engine 120. More specifically, the upper accommodation body 118*u* that defines the outboard motor upper unit UU includes an upper exhaust channel ECu that communicates with the engine 120. The upper exhaust channel ECu includes an upper exhaust port EPu. The upper exhaust port EPu is provided at a position that is located above a waterline when the boat 10 is on the water. Meanwhile, the lower accommodation body 1181 that defines the outboard motor lower unit LU includes a lower exhaust channel EC1. The lower exhaust channel EC1 includes a lower exhaust port EP1. The lower exhaust port EP1 is provided at a position that is located under the waterline when the boat 10 is on the water. In the present preferred embodiment, the lower exhaust port EP1 is near a center of the propeller 112. As will be described below, the upper exhaust channel ECu and the lower exhaust channel EC1 communicate with each other under a certain condition.

In a state where a speed of the engine 120 is relatively low, a pressure of the exhaust gas from the engine 120 is relatively low. Thus, the exhaust gas flows through the upper exhaust channel ECu and is then discharged into the air from the upper exhaust port EPu. In a state where the speed of the engine 120 is relatively high, the pressure of the exhaust gas from the engine 120 is relatively high. Thus, the exhaust gas flows through the upper exhaust channel ECu and is then discharged into the air from the upper exhaust port EPu. In addition to the discharge from the upper exhaust port EPu, in the case where the upper exhaust channel ECu and the lower exhaust channel EC1 communicate with each other, the exhaust gas flows from the upper exhaust channel ECu to the lower exhaust channel EC1 and is then discharged into water from the lower exhaust port EP1. In the present specification, the upper exhaust port EPu will also be referred to as an idle exhaust port, discharge of the exhaust gas from the upper exhaust port EPu will also be referred to as idle discharge, the lower exhaust port EP1 will also be referred to as a boss exhaust port, and discharge of the exhaust gas from the lower exhaust port EP1 will also be referred to as boss discharge.

A switching valve 102 that opens/closes the channel is provided on the upper exhaust channel ECu. When the switching valve 102 is in an open state, the exhaust gas from the engine 120 is able to pass a position of the switching valve 102 on the upper exhaust channel ECu and flow to the lower exhaust channel EC1 side. Meanwhile, when the switching valve 102 is in a closed state, the exhaust gas from the engine 120 is stopped at the position of the switching valve 102 on the upper exhaust channel ECu, and the flow of the exhaust gas to the lower exhaust channel EC1 is restricted.

Next, a description will be made of a configuration of a communication section between the upper exhaust channel ECu and the lower exhaust channel EC1 in the exhaust channel EC with reference to FIG. 4 to FIG. 7.

As illustrated in FIGS. 4, 5, and 7, the flat plate section 181 of the lower component 180, which defines the topmost portion of the lower accommodation body 1181, includes a lower exhaust communication hole 184 that penetrates the flat plate section 181 in the up-down direction. The lower exhaust communication hole 184 is an opening on an upper end side of the lower exhaust channel EC1 in the lower accommodation body 1181. In the present preferred embodiment, an outline shape of the lower exhaust communication hole 184 when seen in the up-down direction is rectangular or substantially rectangular that partially extends for a specified width along a circumferential direction around the steering axis As.

As illustrated in FIGS. 4, 6, and 7, the flat plate section 191 of the upper component 190, which defines the lowermost portion of the upper accommodation body 118*u*, includes an upper exhaust communication hole 194 that penetrates the flat plate section 191 in the up-down direction. The upper exhaust communication hole 194 is an opening on a lower end side of the upper exhaust channel ECu in the upper accommodation body 118*u*. In the present preferred embodiment, an outline shape of the upper exhaust communication hole 194 when seen in the up-down direction has a rectangular or substantially rectangular shape, a width of which along the circumferential direction is narrower than the width of the lower exhaust communication hole 184. An area of the lower exhaust communication hole 184 is larger than an area of the upper exhaust communication hole 194.

Figure 8:
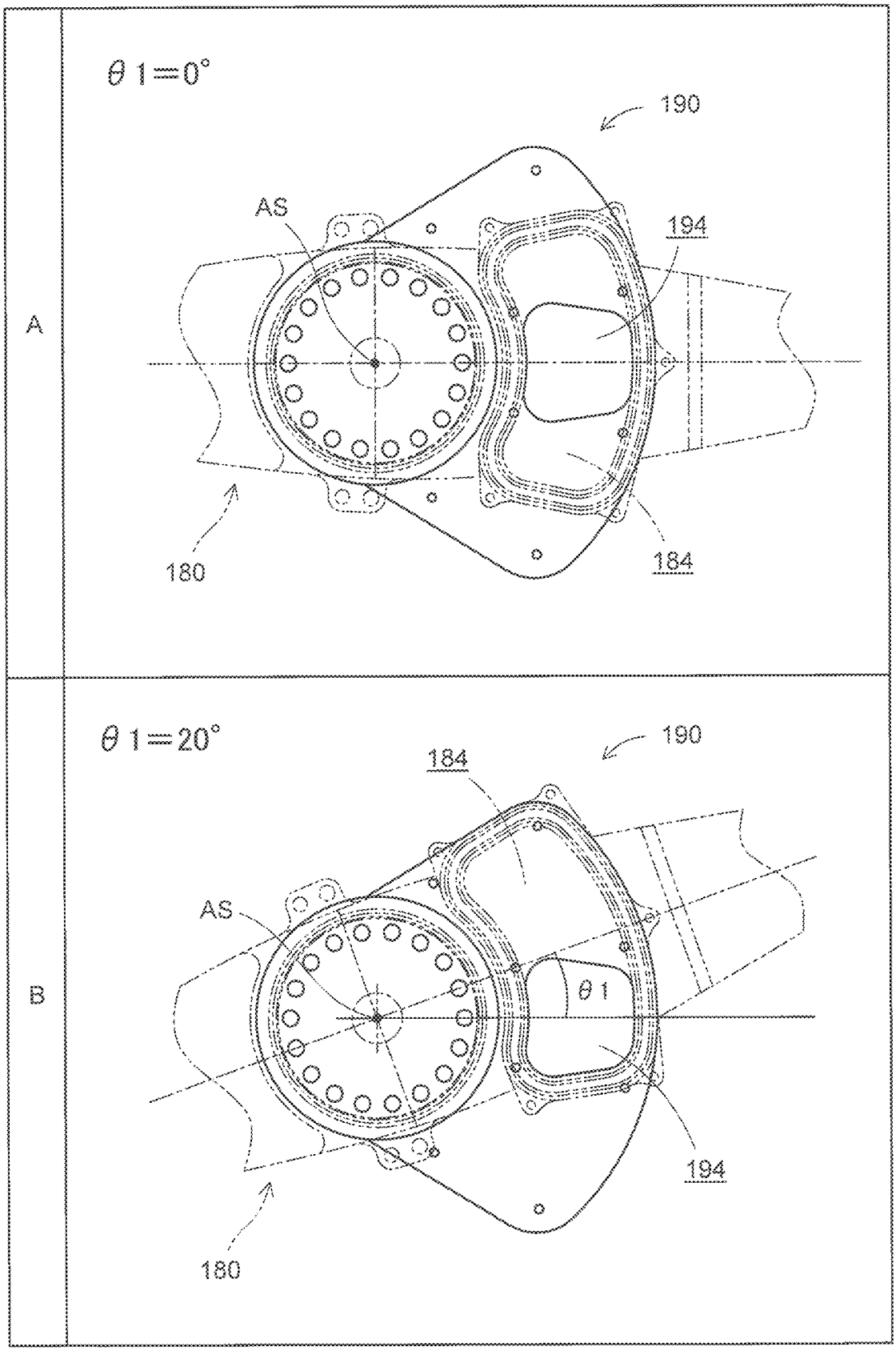
FIG. 8 includes explanatory views illustrating a positional relationship between a lower exhaust communication hole and an upper exhaust communication hole that corresponds to a rudder angle θ1.
Figure 9:
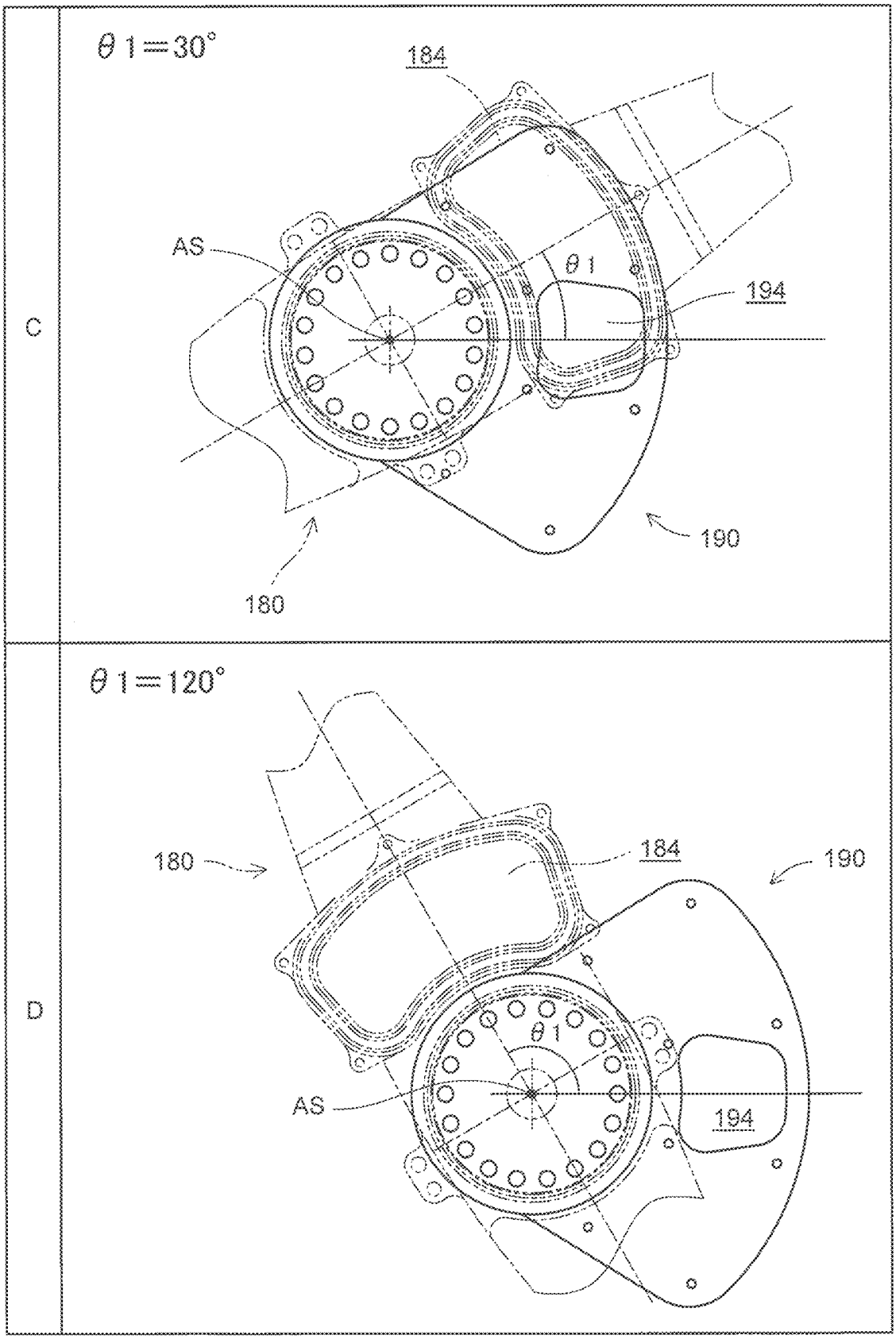
FIG. 9 includes explanatory views illustrating the positional relationship between the lower exhaust communication hole and the upper exhaust communication hole that corresponds to the rudder angle θ1.

FIG. 8 and FIG. 9 each include explanatory views illustrating a positional relationship between the lower exhaust communication hole 184 and the upper exhaust communication hole 194 that corresponds to the rudder angle θ1. Row A of FIG. 8 illustrates the positional relationship between the lower exhaust communication hole 184 and the upper exhaust communication hole 194 (hereinafter simply referred to as the "positional relationship") at the time when the rudder angle θ1 is row B of FIG. 8 illustrates the positional relationship at the time when the rudder angle θ1 is 20°, row C of FIG. 9 illustrates the positional relationship at the time when the rudder angle θ1 is 30°, and row D of FIG. 9 illustrates the positional relationship at the time when the rudder angle θ1 is 120°. The rudder angle θ1 described herein refers to the rudder angle when steering to the right. However, an exhaust mode, which will be described below, is the same at the time of steering to the left.

As illustrated in FIG. 8 and FIG. 9, when the lower component 180 rotates about the steering axis As with respect to the upper component 190 due to steering, the positional relationship between the lower exhaust communication hole 184 and the upper exhaust communication hole 194 is changed. More specifically, the lower exhaust communication hole 184 relatively rotates about the steering axis As. In this way, a communication area between the lower exhaust communication hole 184 and the upper exhaust communication hole 194, that is, a communication area between the lower exhaust channel EC1 and the upper exhaust channel ECu (hereinafter referred to as an "exhaust channel communication area Se") is changed.

Figure 10:
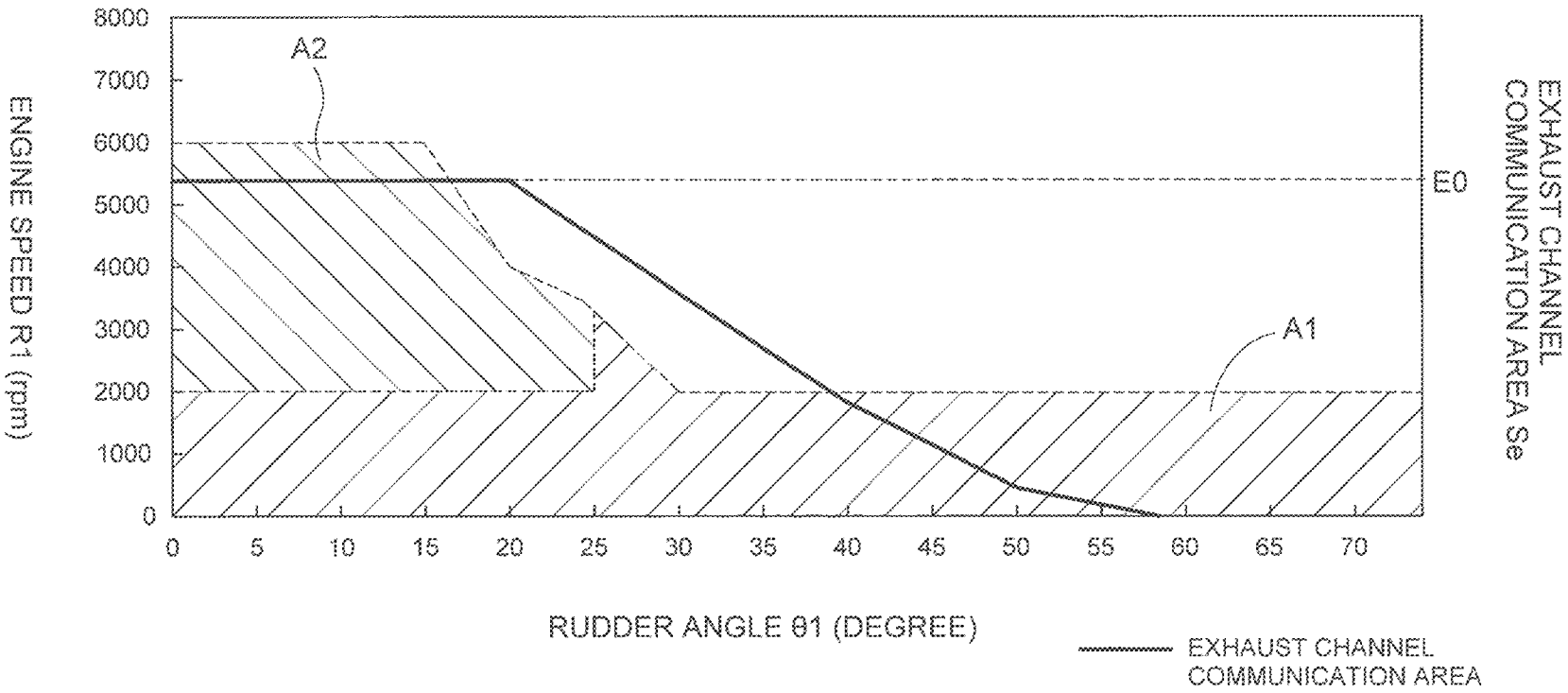
FIG. 10 is an explanatory graph illustrating an exhaust mode that corresponds to a speed of an engine in the outboard motor and the rudder angle θ1.

FIG. 10 is an explanatory graph illustrating the exhaust mode that corresponds to the speed of the engine 120 in the outboard motor 100 and the rudder angle θ1 according to the present preferred embodiment. As illustrated in FIG. 10, in a state where the rudder angle θ1 is equal to or larger than 0° and equal to or smaller than 20° (see rows A, B in FIG. 8), when seen in the up-down direction, the entire upper exhaust communication hole 194, which is in the upper component 190, overlaps (is included in) the lower exhaust communication hole 184, which is in the lower component 180. In this state, the upper exhaust channel ECu, which is in the upper accommodation body 118*u*, and the lower exhaust channel EC1, which is in the lower accommodation body 1181, are brought into a communication state and thus communicate with each other, and the discharge (the boss discharge) of the exhaust gas into water via the lower exhaust channel EC1 and the lower exhaust port EP1 is enabled. In this state, the exhaust channel communication area Se obtains a maximum value E0.

In a state where the rudder angle θ1 is larger than 20° and equal to or smaller than about 57° (see row C in FIG. 9), when seen in the up-down direction, the upper exhaust communication hole 194, which is in the upper component 190, partially overlaps the lower exhaust communication hole 184, which is in the lower component 180, while the rest of the upper exhaust communication hole 194 does not overlap the lower exhaust communication hole 184. In a state where the rudder angle θ1 is larger than about 57° (see row D in FIG. 9), when seen in the up-down direction, the entire upper exhaust communication hole 194, which is in the upper component 190, does not overlap the lower exhaust communication hole 184, which is in the lower component 180. In this state, at least a portion of the upper exhaust communication hole 194 of the upper exhaust channel ECu in the upper accommodation body 118*u* and at least a portion of the lower exhaust communication hole 184 of the lower exhaust channel EC1 in the lower accommodation body 1181 are brought into a non-communication state and thus do not communicate with each other, and the discharge of the exhaust gas (the boss discharge) into the water via the lower exhaust channel EC1 and the lower exhaust port EP1 is disabled. At this time, in order to restrict the flow of the exhaust gas from the upper exhaust channel ECu to the lower exhaust channel EC1 side, the switching valve 102 is brought into the closed state.

As illustrated in FIG. 10, a maximum value of a speed R1 of the engine 120 is 6000 rpm for the boat 10 of the present preferred embodiment, for example. However, during the actual boat operation, a sailing speed tends to be reduced as the rudder angle θ1 is increased. In conjunction therewith, the speed R1 of the engine 120 also tends to be reduced. Accordingly, in the actual boat operation, hatched regions in FIG. 10 (a first region A1 and a second region A2) are used.

In the present preferred embodiment, in the case where the speed R1 of the engine 120 is equal to or lower than a specified value (for example, 2000 rpm) or the rudder angle θ1 is equal to or larger than a specified value (for example, 25°) (that is, in the case where the speed R1 and the rudder angle θ1 are located within the first region A1 in FIG. 10), the idle discharge is performed to discharge the exhaust gas from the engine 120 into the air from the upper exhaust port EPu. At this time, in order to restrict the flow of the exhaust gas from the upper exhaust channel ECu to the lower exhaust channel EC1 side, the switching valve 102 is brought into the closed state.

On the other hand, in the case where the speed R1 of the engine 120 is higher than the specified value (for example, 2000 rpm) and the rudder angle θ1 is smaller than the specified value (for example, 25°) (that is, in the case where the speed R1 and the rudder angle θ1 are located within the second region A2 in FIG. 10), the boss discharge is performed to discharge the exhaust gas from the engine 120 into the water from the lower exhaust port EP1 in addition to the idle discharge to discharge the exhaust gas from the engine 120 into the air from the upper exhaust port EPu. At this time, in order to allow the flow of the exhaust gas flows from the upper exhaust channel ECu to the lower exhaust channel EC1 side, the switching valve 102 is brought into the open state.

Here, a required exhaust area varies according to the rudder angle θ1 (that is, by the speed R1 of the engine 120).

For this reason, an area of each section of the exhaust channel EC is set to secure the required exhaust area in the state regardless of the values of the rudder angle θ1 and the speed R1 of the engine 120. For example, the maximum value E0 of the exhaust channel communication area Se is set to a sufficient value to discharge the exhaust gas from the engine 120, which is driven at the highest speed (for example, 6000 rpm).

As illustrated in FIG. 2 and FIG. 4, the outboard motor body 110 includes a coolant channel CC through which a coolant to cool the engine 120 flows. More specifically, the upper accommodation body 118*u* that defines the outboard motor upper unit UU includes an upper coolant channel CCu that communicates with the engine 120. Meanwhile, the lower accommodation body 1181 that defines the outboard motor lower unit LU includes a lower coolant channel CC1. The lower coolant channel CC1 includes a coolant intake port WI. The coolant intake port WI is provided at a position under the waterline when the boat 10 is on the water. In the present preferred embodiment, the coolant intake port WI is in the lower casing 116*b*. The upper coolant channel CCu and the lower coolant channel CC1 communicate with each other.

The coolant to cool the engine 120 is pumped from the coolant intake port WI by a coolant pump (not illustrated) that is driven in conjunction with the rotation of the drive-shaft 132. The pumped coolant flows upward through the lower coolant channel CC1 and the upper coolant channel CCu and is then supplied to the engine 120. The coolant that has been used to cool the engine 120 is discharged to the outside via a coolant channel for discharge, which is not illustrated. The coolant that has been used to cool the engine 120 may be mixed with the exhaust gas from the engine 120 and then discharged to the outside.

Next, a description will be made of a configuration of a communication section between the upper coolant channel CCu and the lower coolant channel CC1 in the coolant channel CC with reference to FIG. 4 to FIG. 7.

As illustrated in FIGS. 4, 5, and 7, the tubular section 182 of the lower component 180, which defines the topmost portion of the lower accommodation body 1181, includes a plurality of lower coolant communication holes 186, each of which extends in a radial direction of the tubular section 182. Each of the lower coolant communication holes 186 is an opening on an upper end side of the lower coolant channel CC1 in the lower accommodation body 1181. The lower coolant communication hole 186 is an example of the second communication port.

As illustrated in FIGS. 4, 6, and 7, the box-shaped section 193 of the upper component 190, which defines the lowermost portion of the upper accommodation body 118*u*, includes an upper coolant communication hole 196 that extends in the horizontal direction. The upper coolant communication hole 196 is an opening on a lower end side of the upper coolant channel CCu in the upper accommodation body 118*u*. The upper coolant communication hole 196 is an example of the first communication port.

The lower coolant channel CC1 and the upper coolant channel CCu communicate with each other via the lower coolant communication holes 186 and the upper coolant communication hole 196. When the lower component 180 rotates about the steering axis As with respect to the upper component 190 due to steering, a positional relationship between the lower coolant communication holes 186 and the upper coolant communication hole 196 is changed. In this way, a communication area between the lower coolant communication holes 186 and the upper coolant communication hole 196, that is, a communication area between the lower coolant channel CC1 and the upper coolant channel CCu (hereinafter referred to as a "coolant channel communication area Sc") is changed. As a result, an amount of the coolant that is supplied to the engine 120 via the coolant channel CC is changed.

Figure 11:
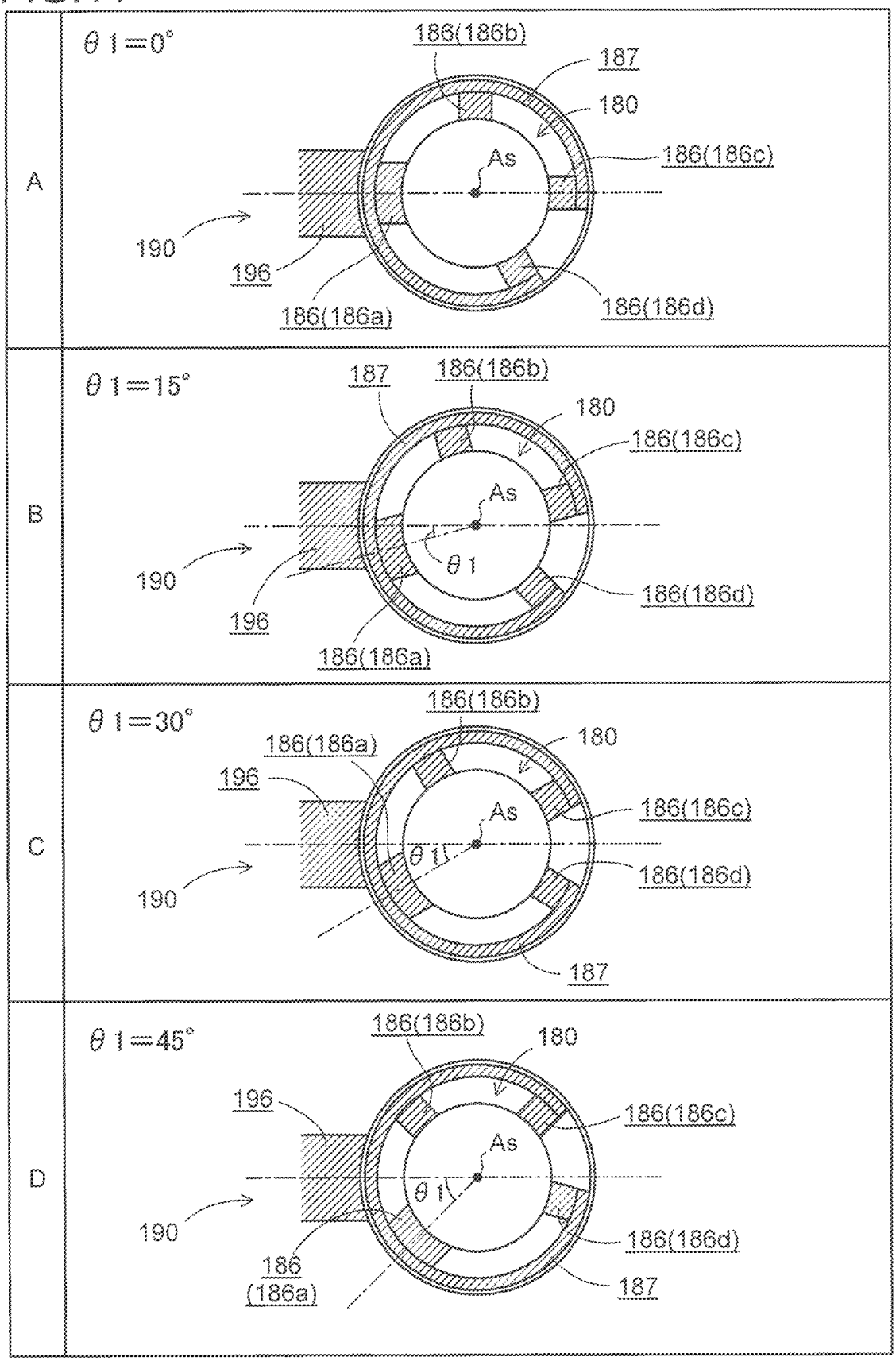
FIG. 11 includes explanatory views illustrating a positional relationship between a lower coolant communication hole and an upper coolant communication hole that corresponds to the rudder angle θ1.
Figure 12:
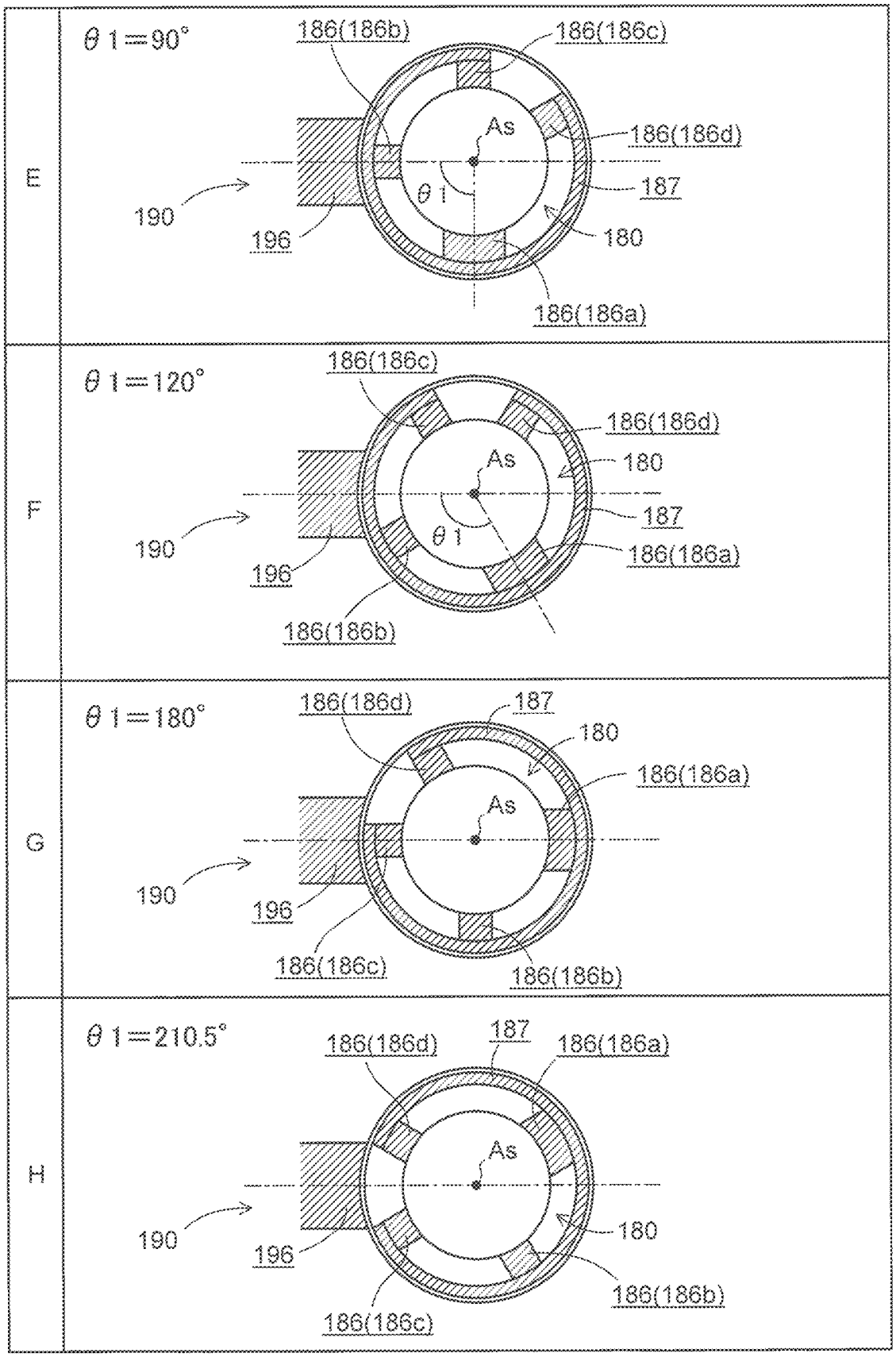
FIG. 12 includes explanatory views illustrating the positional relationship between the lower coolant communication hole and the upper coolant communication hole that corresponds to the rudder angle θ1.

FIG. 11 and FIG. 12 each include explanatory views illustrating the positional relationship between the lower coolant communication holes 186 and the upper coolant communication hole 196 that corresponds to the rudder angle θ1. Row A of FIG. 11 illustrates the positional relationship between the lower coolant communication holes 186 and the upper coolant communication hole 196 (hereinafter simply referred to as the "positional relationship") at the time when the rudder angle θ1 is 0°. Row B of FIG. 11 illustrates the positional relationship at the time when the rudder angle θ1 is 15°. Row C of FIG. 11 illustrates the positional relationship at the time when the rudder angle θ1 is 30°. Row D of FIG. 11 illustrates the positional relationship at the time when the rudder angle θ1 is 45°. Row E of FIG. 12 illustrates the positional relationship at the time when the rudder angle θ1 is 90°. Row F of FIG. 12 illustrates the positional relationship at the time when the rudder angle θ1 is 120°. Row G of FIG. 12 illustrates the positional relationship at the time when the rudder angle θ1 is 180°. Row H of FIG. 12 illustrates the positional relationship at the time when the rudder angle θ1 is 210.5°. The rudder angle θ1 described herein refers to the rudder angle when steering to the right. As illustrated in FIG. 11 and FIG. 12, in the present preferred embodiment, the plurality of lower coolant communication holes 186 in the lower component 180 include the at least two lower coolant communication holes 186, the opening areas of which differ from each other. The plurality of lower coolant communication holes 186 are arranged unequally along the circumferential direction around the steering axis As. The opening area of the upper coolant communication hole 196 in the upper component 190 is larger than the opening area of the lower coolant communication hole 186.

As illustrated in FIG. 11 and FIG. 12, the four lower coolant communication holes 186 are in the lower component 180. The four lower coolant communication holes 186 are arranged along the circumferential direction around the steering axis As. In a state where the rudder angle θ1 is 0' (see row A in FIG. 11), one (hereinafter referred to as a "first lower coolant communication hole 186*a*") of the four lower coolant communication holes 186 is opened forward, another one (hereinafter referred to as a "second lower coolant communication hole 186*b*") is opened rightward, further another one (hereinafter referred to as a "third lower coolant communication hole 186*c*") is opened rearward, and the other one (hereinafter referred to as a "fourth lower coolant communication hole 186*d*") is opened rearward and obliquely leftward. Just as described, in the present preferred embodiment, the second lower coolant communication hole 186*b* and the fourth lower coolant communication hole 186*d* are arranged asymmetrically in the circumferential direction with the position of the first lower coolant communication hole 186*a* being a reference. A channel area (an area of a cross section that is orthogonal to an extending direction) of the first lower coolant communication hole 186*a* is larger than a channel area of each of the remaining three lower coolant communication holes 186.

In the present preferred embodiment, a groove channel 187 is provided on an outer circumferential surface of the tubular section 182 of the lower component 180, and the groove channel 187 allows the four lower coolant communication holes 186 to communicate with each other. However, the groove channel 187 is not provided between the third lower coolant communication hole 186*c* and the fourth lower coolant communication hole 186*d*. The lower coolant channel CC1 communicates with the upper coolant channel CCu via the lower coolant communication holes 186, and also communicates with the upper coolant channel CCu via the groove channel 187.

Figure 13:
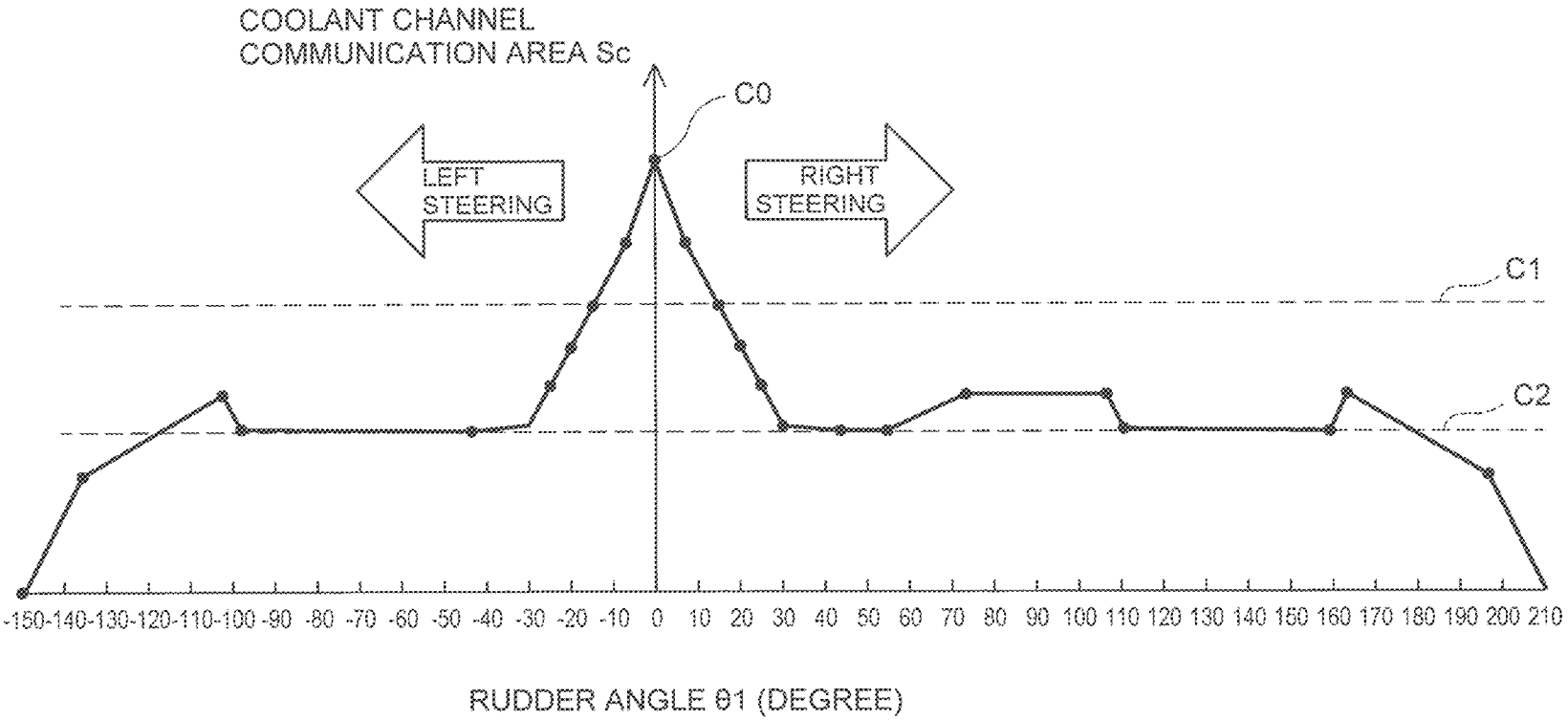
FIG. 13 is an explanatory graph illustrating a coolant channel communication area Sc that corresponds to the rudder angle θ1 in the outboard motor according to a preferred embodiment of the present invention.

FIG. 13 is an explanatory graph illustrating the coolant channel communication area Sc that corresponds to the rudder angle θ1 in the outboard motor 100 according to the present preferred embodiment. As illustrated in FIG. 13, in the state where the rudder angle θ1 is 0° (see row A in FIG. 11), the entire first lower coolant communication hole 186*a* communicates with the upper coolant communication hole 196, and the coolant channel communication area Sc obtains a maximum value C0. The maximum value C0 of the coolant channel communication area Sc is set to a larger value than a first value C1 of the coolant channel communication area Sc that is required to supply a sufficient amount of the coolant to cool the engine 120, which is driven at the maximum speed (for example, 6000 rpm).

In a state where the rudder angle θ1 is larger than 0° and equal to or smaller than about 42° when steering to the right (see the rows B, C in FIG. 11), the first lower coolant communication hole 186*a* communicates with the upper coolant communication hole 196. However, the communication area between the first lower coolant communication hole 186*a* and the upper coolant communication hole 196 is gradually reduced due to the increase in the rudder angle θ1. In the present preferred embodiment, when the rudder angle θ1 becomes larger than about 15°, the coolant channel communication area Sc falls below the above-described first value C1. When the rudder angle θ1 is about 42°, the coolant channel communication area Sc is equal to a second value C2 of the coolant channel communication area Sc that is required to supply the sufficient amount of the coolant to cool the engine 120, which is driven at a middle speed (for example, 3000 rpm).

In a state where the rudder angle θ1 is larger than about 42° and equal to or smaller than about 55° (see the row D in FIG. 11) when steering to the right, none of the lower coolant communication holes 186 communicates with the upper coolant communication hole 196. Accordingly, in this state, the lower coolant channel CC1 communicates with the upper coolant channel CCu only via the groove channel 187, and the coolant channel communication area Sc is equal to the communication area via the groove channel 187.

In a state where the rudder angle θ1 is larger than about 55° and equal to or smaller than about 110° (see the row E in FIG. 12) when steering to the right, the second lower coolant communication hole 186*b* communicates with the upper coolant communication hole 196. More specifically, the communication area between the second lower coolant communication hole 186*b* and the upper coolant communication hole 196 is gradually increased due to the increase in the rudder angle θ1 in a range where the rudder angle θ1 is larger than about 55° and equal to or smaller than about 72°, remains constant regardless of the rudder angle θ1 in a range where the rudder angle θ1 is larger than about 72° and equal to or smaller than about 107°, and is gradually reduced due to the increase in the rudder angle θ1 in a range where the rudder angle θ1 is larger than about 107° and equal to or smaller than about 110°.

In a state where the rudder angle θ1 is larger than about 110° and equal to or smaller than about 160° (see the row F in FIG. 12) when steering to the right, none of the lower coolant communication holes 186 communicates with the upper coolant communication hole 196. Accordingly, in this state, the lower coolant channel CC1 communicates with the upper coolant channel CCu only via the groove channel 187, and the coolant channel communication area Sc is equal to the communication area via the groove channel 187.

In a state where the rudder angle θ1 is larger than about 160° and smaller than about 210.5° (see row G in FIG. 12) when steering to the right, the third lower coolant communication hole 186*c* communicates with the upper coolant communication hole 196. More specifically, the communication area between the third lower coolant communication hole 186*c* and the upper coolant communication hole 196 is gradually increased due to the increase in the rudder angle θ1 in a range where the rudder angle θ1 is larger than about 160° and equal to or smaller than about 163°. Accordingly, in this rudder angle range, the coolant channel communication area Sc is gradually increased due to the increase in the rudder angle θ1. In a range where the rudder angle θ1 is larger than about 163° and equal to or smaller than about 197°, the communication area between the third lower coolant communication hole 186*c* and the upper coolant communication hole 196 remains constant regardless of the rudder angle θ1. However, when the rudder angle θ1 exceeds about 163° when steering to the right, a portion of the lower component 180 not provided with the groove channel 187 (a portion between the third lower coolant communication hole 186*c* and the fourth lower coolant communication hole 186*d*) opposes the upper coolant communication hole 196. Thus, in the range where the rudder angle θ1 is larger than about 163° and equal to or smaller than about 197°, the coolant channel communication area Sc is gradually reduced due to the increase in the rudder angle θ1. In a range where the rudder angle θ1 is larger than about 197° and smaller than about 210.5°, the communication area between the third lower coolant communication hole 186*c* and the upper coolant communication hole 196 is gradually reduced due to the increase in the rudder angle θ1. Accordingly, in this rudder angle range, in conjunction with the increase in the rudder angle θ1, the coolant channel communication area Sc is reduced steeply (with a steeper gradient than a gradient at the time when the rudder angle θ1 is larger than about 163° and equal to or smaller than about 197°). In the present preferred embodiment, when the rudder angle θ1 becomes larger than about 177°, the coolant channel communication area Sc falls below the above-described second value C2.

When the rudder angle θ1 becomes 210.5° (see row H in FIG. 12) when steering to the right, none of the lower coolant communication holes 186 communicates with the upper coolant communication hole 196. Furthermore, the groove channel 187 does not communicate with the upper coolant communication hole 196, either. Accordingly, in this state, the coolant channel communication area Sc becomes zero.

As described above, the coolant channel CC is generally configured such that the coolant channel communication area Sc is reduced as the rudder angle θ1 is increased. In other words, the upper coolant channel CCu and the lower coolant channel CC1 are configured that the coolant channel communication area Sc obtains the first area value when the rudder angle θ1 has the first rudder angle value and that the coolant channel communication area Sc obtains the second area value, which is smaller than the first area value, when the rudder angle θ1 has the second rudder angle value, which is larger than the first rudder angle value.

As illustrated in FIG. 13, also when steering to the left, the coolant channel communication area Sc is changed according to the change in the rudder angle θ1 in a similar manner to the case of steering to the right. However, as described above, since the second lower coolant communication hole 186*b* and the fourth lower coolant communication hole 186*d* are arranged asymmetrically in the circumferential direction with the position of the first lower coolant communication hole 186*a* being the reference, a change mode of the coolant channel communication area Sc that corresponds to the change in the rudder angle θ1 when steering to the left is not the same as a change mode of the coolant channel communication area Sc that corresponds to the change in the rudder angle θ1 when steering to the right.

As it has been described so far, the upper accommodation body 118*u* includes the upper coolant channel CCu, the lower accommodation body 1181 includes the lower coolant channel CC1 including the coolant intake port W1, and the upper coolant channel CCu and the lower coolant channel CC1 are configured so that the communication area therebetween is changed according to the rudder angle θ1 of the steering mechanism 170. Therefore, compared to a configuration that the annular communication channel is provided to one of the upper coolant channel CCu and the lower coolant channel CC1 so as to keep the constant communication area therebetween regardless of the rudder angle θ1, it is possible to reduce the space to provide the coolant channel CC, and thus improve a degree of freedom in layout of the outboard motor 100 and reduce a size and weight of the outboard motor 100.

The techniques disclosed in the present specification are not limited to the above-described preferred embodiments, and various modifications may be made within the scope that does not depart from the gist thereof. For example, the following modifications may be made.

The configurations of the boat 10 according to the above preferred embodiments are merely examples, and various modifications may be made thereto. For example, in the above preferred embodiments, the lower exhaust communication hole 184 is configured as the hole (the elongated hole) that extends along the circumferential direction around the steering axis As, and thus, the communication area between the lower exhaust communication hole 184 and the upper exhaust communication hole 194, that is, the exhaust channel communication area Se, is changeable according to the rudder angle θ1. On the contrary, the upper exhaust communication hole 194 may be configured as an elongated hole, and thus, the communication area between the lower exhaust communication hole 184 and the upper exhaust communication hole 194, that is, the exhaust channel communication area Se, is changeable according to the rudder angle θ1.

The exhaust modes (FIG. 10) that correspond to the speed of the engine 120 and the rudder angle θ1 in the above preferred embodiments are merely examples, and various modifications may be made thereto. For example, in the above preferred embodiments, the idle discharge is performed when the speed R1 of the engine 120 is equal to or lower than the specified value (for example, 2000 rpm) or the rudder angle θ1 is equal to or larger than the specified value (for example, 25°), and the idle discharge and the boss discharge are performed when the speed R1 of the engine 120 is higher than the above specified value and the rudder angle θ1 is smaller than the above specified value. On the contrary, the exhaust modes may be divided by the speed R1 of the engine 120. The idle discharge may be performed when the speed R1 of the engine 120 is equal to or lower than the specified value, and the idle discharge and the boss discharge may be performed when the speed R1 of the engine 120 is higher than the above specified value. Alternatively, the exhaust modes may be divided by the rudder angle θ1. The idle discharge may be performed when the rudder angle θ1 is equal to or larger than the specified value, and the idle discharge and the boss discharge may be performed when the rudder angle θ1 is smaller than the above specified value.

In the above preferred embodiments, the switching valve 102 is provided to the exhaust channel EC. However, a switching mechanism other than the switching valve 102 may be provided. In addition, the switching valve 102 may not be provided. In the above preferred embodiments, the lower exhaust port EP1 is provided near the center of the propeller 112. However, the lower exhaust port EP1 may be provided at another position (for example, a position above the propeller 112). In addition to the upper exhaust port EPu and the lower exhaust port EP1, the exhaust channel EC may be provided with another exhaust port (for example, an exhaust port that is located between the upper exhaust port EPu and the lower exhaust port EP1 along the up-down direction).

Figure 14:
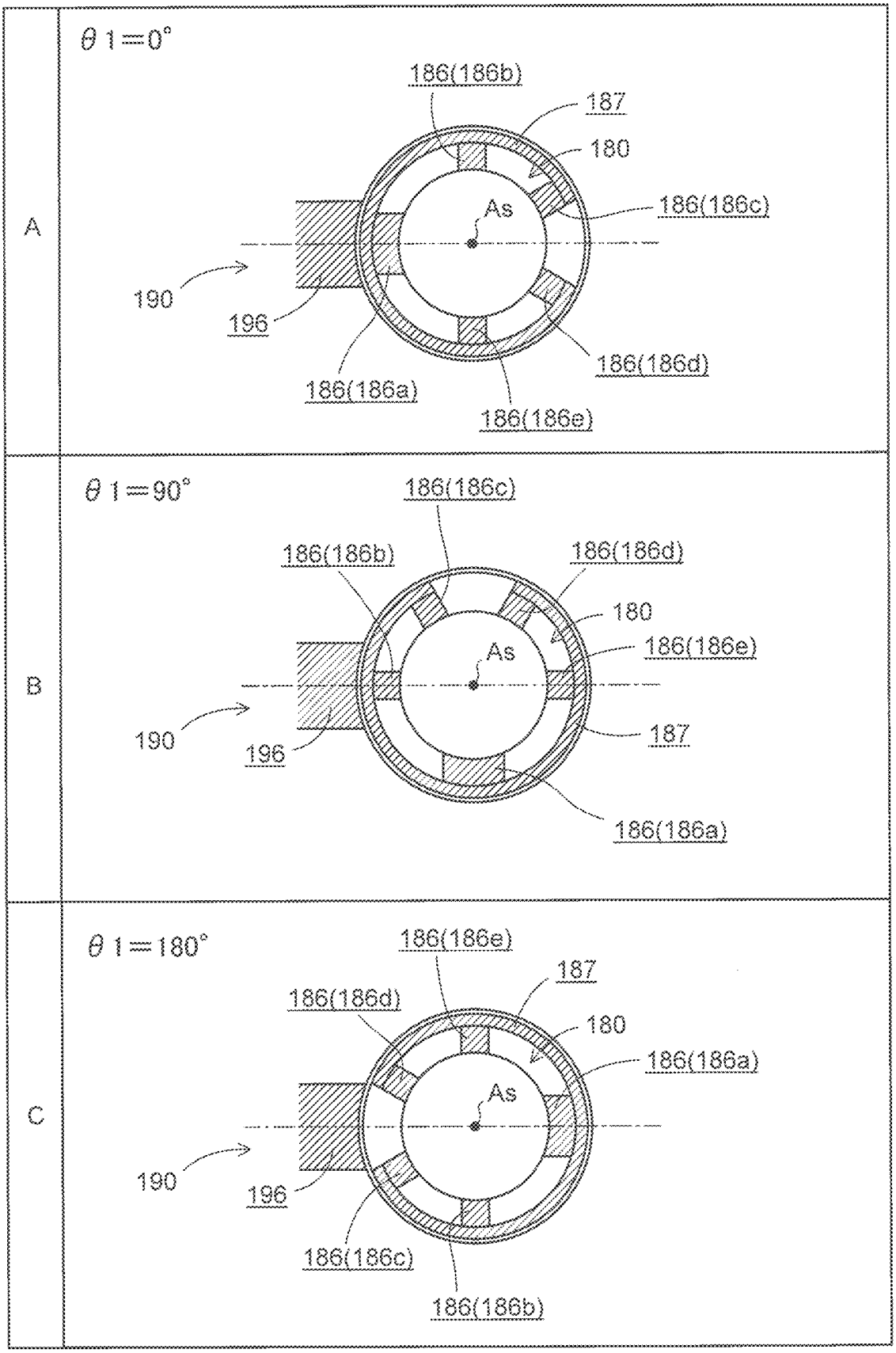
FIG. 14 includes explanatory views illustrating a positional relationship between the lower coolant communication hole and the upper coolant communication hole that corresponds to the rudder angle θ1 in a modification of a preferred embodiment of the present invention.

In the above preferred embodiments, in regard to the four lower coolant communication holes 186 in the lower component 180, some of the lower coolant communication holes 186 are arranged asymmetrically in the circumferential direction with the first lower coolant communication hole 186*a* being the reference. However, as in a modification illustrated in FIG. 14, all of the lower coolant communication holes 186 may be arranged symmetrically in the circumferential direction with the first lower coolant communication hole 186*a* being the reference. In the modification, row A of FIG. 14 illustrates the positional relationship between the lower coolant communication holes 186 and the upper coolant communication hole 196 (hereinafter simply referred to as the "positional relationship") at the time when the rudder angle θ1 is 0°, row B of FIG. 14 illustrates the positional relationship at the time when the rudder angle θ1 is 90° when steering to the right, and row C of FIG. 14 illustrates the positional relationship at the time when the rudder angle θ1 is 180°.

In the above preferred embodiments, the plurality of lower coolant communication holes 186 are provided in the lower component 180 defining the lower accommodation body 1181 and the coolant channel communication area Sc is changed according to the rudder angle θ1. However, it may be configured that the plurality of upper coolant communication holes 196 are provided in the upper component 190 defining the upper accommodation body 118*u* and the coolant channel communication area Sc is changed according to the rudder angle θ1.

The aspect of the coolant channel communication area Sc in the above preferred embodiments (FIG. 13) is merely one example, and various modifications can be made thereto. For example, in the above preferred embodiments, the coolant channel communication area Sc is changed according to the rudder angle θ1. However, it may be configured that the coolant channel communication area Sc is changed according to the speed R1 of the engine 120 instead of the rudder angle θ1 or in addition to the rudder angle θ1. Such a configuration may be achieved, for example, by providing an opening/closing mechanism (a valve or the like), which is opened/closed according to the speed R1 of the engine 120 (for example, according to a water pressure correlated with the speed R1 of the engine 120), between the coolant pump and the engine 120.

In the above preferred embodiments, the steering axis As of the steering mechanism 170 is the center axis of the driveshaft 132. However, the steering axis As of the steering mechanism 170 may be a different axis from the center axis of the driveshaft 132. In the above preferred embodiments, the outboard motor 100 includes the steering mechanism 170 that causes the outboard motor lower unit LU to rotate about the steering axis As. However, in addition to such a steering mechanism 170, the outboard motor 100 may include a second steering mechanism that causes the entire outboard motor body 110 to rotate about a second steering axis.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:
an engine;
a propeller shaft;
a propeller attached to the propeller shaft;
a transmission to transmit rotation of the engine to the propeller shaft;
an upper accommodation body that accommodates at least a portion of the engine;
a lower accommodation body that accommodates at least a portion of the propeller shaft; and
a steering to cause the lower accommodation body to rotate about a steering axis with respect to the upper accommodation body; wherein
the upper accommodation body includes an upper coolant channel;
the lower accommodation body includes a lower coolant channel including a coolant intake port;
the upper coolant channel communicates with the lower coolant channel along a direction perpendicular to the steering axis; and
a communication area between the upper coolant channel and the lower coolant channel is changeable according to a rudder angle of the steering.

2. The outboard motor according to claim 1, wherein the communication area has a first area value when the rudder angle has a first rudder angle value, and a second area value smaller than the first area value when the rudder angle has a second rudder angle value larger than the first rudder angle value.

3. The outboard motor according to claim 1, wherein
one of the upper coolant channel and the lower coolant channel includes a communication port; and
the other of the upper coolant channel and the lower coolant channel includes a plurality of communication ports located along a circumferential direction around the steering axis, a total area of the plurality of communication ports overlapping the communication port being changed according to the rudder angle.

4. The outboard motor according to claim 3, wherein the plurality of communication ports includes at least two communication ports, and opening areas of the at least two communication ports differ from each other.

5. The outboard motor according to claim 3, wherein the plurality of communication ports are located at unequal intervals along the circumferential direction around the steering axis.

6. The outboard motor according to claim 3, wherein an opening area of the communication port is larger than an opening area of the plurality of communication ports.

7. A boat comprising:
a hull; and
the outboard motor according to claim 1 attached to a rear portion of the hull.

8. An outboard motor comprising:
an engine;
a propeller shaft;
a propeller attached to the propeller shaft;
a transmission to transmit rotation of the engine to the propeller shaft;
an upper accommodation body that accommodates at least a portion of the engine;
a lower accommodation body that accommodates at least a portion of the propeller shaft; and
a steering to cause the lower accommodation body to rotate about a steering axis with respect to the upper accommodation body; wherein
the upper accommodation body includes an upper coolant channel;
the lower accommodation body includes a lower coolant channel including a coolant intake port;
the upper coolant channel communicates with the lower coolant channel along a direction perpendicular to the steering axis; and
a communication area between the upper coolant channel and the lower coolant channel is changeable according to a rudder angle of the steering or a speed of the engine.

9. The outboard motor according to claim 8, wherein the communication area has a first area value when the rudder angle has a first rudder angle value, and a second area value smaller than the first area value when the rudder angle has a second rudder angle value larger than the first rudder angle value.

10. The outboard motor according to claim 8, wherein
one of the upper coolant channel and the lower coolant channel includes a communication port;
the other of the upper coolant channel and the lower coolant channel includes a plurality of communication ports arranged along a circumferential direction around the steering axis; and
a total area of the plurality of communication ports overlapping the communication port is changeable according to the rudder angle.

11. The outboard motor according to claim 10, wherein the plurality of communication ports includes at least two communication ports, and opening areas of the at least two communication ports differ from each other.

12. The outboard motor according to claim 10, wherein the plurality of communication ports are located at unequal intervals along the circumferential direction around the steering axis.

13. The outboard motor according to claim 10, wherein an opening area communication port is larger than an opening area of the plurality of communication ports.

14. A boat comprising:
a hull; and
the outboard motor according to claim 8 attached to a rear portion of the hull.

* * * * *